United States Patent [19]

Svenson

[11] 4,289,638

[45] Sep. 15, 1981

[54] METAL TREATMENT

[76] Inventor: Bruce E. Svenson, 852a Pittwater Rd., Dee Why, N.S.W., Australia, 2099

[21] Appl. No.: 80,794

[22] Filed: Sep. 28, 1979

[30] Foreign Application Priority Data

[AU] Australia .....

[51] Int. Cl.[3] ..... C09G 1/02; C11D 7/08; C11D 7/20; C11D 7/46

[52] U.S. Cl. ..... 252/85; 106/8; 106/14.12; 106/14.14; 134/3; 252/82; 252/87; 252/136; 252/142; 252/143; 252/144; 252/145

[58] Field of Search ..... 252/82, 87, 100, 136, 252/142, 143, 144, 145; 134/3; 148/6.15 R; 106/8, 14.12

[56] References Cited

U.S. PATENT DOCUMENTS

| | | | |
|---|---|---|---|
| 1,398,507 | 11/1921 | Gravell | 252/143 |
| 1,740,731 | 12/1929 | Gravell | 252/144 |
| 1,949,921 | 3/1934 | Schweitzer | 252/143 |
| 1,992,045 | 2/1935 | Schweitzer | 252/143 |
| 2,658,846 | 11/1953 | De Rosa | 148/6.15 R |
| 2,672,449 | 3/1954 | Snell | 252/100 |

FOREIGN PATENT DOCUMENTS

| | | | |
|---|---|---|---|
| 166027 | 8/1954 | Australia | 252/136 |
| 582672 | 9/1959 | Canada | 252/87 |
| 1091400 | 10/1960 | Fed. Rep. of Germany | 252/136 |
| 447088 | 8/1912 | France | 252/87 |
| 1479591 | 7/1977 | United Kingdom | 252/87 |

*Primary Examiner*—Dennis L. Albrecht
*Attorney, Agent, or Firm*—Darby & Darby

[57] ABSTRACT

A rust treatment and inhibitor preparation includes a strong acid, such as concentrated phosphoric acid, within an emulsion including wool fat or grease and derivatives. Solvents, stabilizers and absorbing agents are provided in the emulsion. The emulsion enables the acid to remove rust and protect the treated surface from further corrosion without affecting the surface finish.

3 Claims, No Drawings

METAL TREATMENT

This invention relates to the field of rust treatment. In particular, this invention provides a product effective in the treatment of rust and having properties which enable it to have wide application in the metal or motor industry.

Rust is the product of oxidation of iron or steel which may result, if left untreated, in the metal being completely oxidized. Consequently, the physical and chemical properties of the metal are destroyed, the appearance of the metal is affected and the metal depreciates in value. Hence it is for these reasons that once rust is discovered, e.g. in a motor vehicle, there exists a problem to be solved. Rust treatment desirably involves treating the corroded metal surface in such a manner that existing corrosion ceases, and further corrosion is prevented. This invention proposes to overcome the problems associated with rust to provide an effective rust treatment and an effective method of application.

In its broadest aspect, the invention provides a rust treatment preparation comprising a strong acid, in an emulsion comprised of wool fat, wool grease and/or derivatives thereof, optionally together with a solvent therefor, and/or a stabilising and/or absorbing agent. In a related aspect, the invention provides a process for the manufacture of such a preparation wherein, essentially, the strong acid is emulsified by wool fat, wool grease and/or derivatives thereof.

More specifically, the invention also provides a rust treatment preparation comprising concentrated phosphoric acid in an emulsion comprised of wool fat, wool grease and/or derivatives thereof, kaolin, and methylated or industrial spirits. Alternative processes for the manufacture of this specific preparation are also envisaged, as indicated hereafter.

The invention will now be described with reference to the preferred forms thereof. It should be noted that the details of the ensuing description are merely illustrative of the invention and are not to be limitatively construed.

The acid used in the present invention and found to be particularly suitable, is (as indicated above) concentrated phosphoric acid (for example 95%). The use of concentrated phosphoric acid, per se, for the removal of rust is well-known but it has the following undesirable properties: it is easily removed from a surface by washing with water, it does not protect the surface against further corrosion, and, when applied to a motor vehicle, it affects the duco, the paint work or surface finish of the vehicle. Quite unexpectedly, I have found that the acid can be emulsified by the wool fat (et al) component referred to hereinbefore. Thus, the preparation of the present invention, which, in its specific aspect, comprises the said phosphoric acid in an emulsion, overcomes all the problems associated with the use of phosphoric acid per se.

The emulsion is creamy, stable, actively acidic for an effective length of time to ensure complete reaction, and has the properties, as previously mentioned, of being difficult to remove by washing with water, of protecting the surfaces against further corrosion and apparently not affecting the duco of a motor vehicle. As concentrated phosphoric acid is a strong acid, a stable emulsion is usually difficult to achieve but the emulsion of the present invention is characterised by its stability.

Besides acting as a solvent for the wool fat component, the methylated or industrial spirits functions as a drying agent which, whilst it dilutes the acid, does not effect its strength. The kaolin, which may be in the form of colloidal kaolin or light kaolin (as is known in the art), in addition to stabilising the emulsion, also functions as an absorbent. Apart from emulsifying the acid, the wool fat (et al) component provides the good water repellant properties that characterise the instant rust treatment preparation—in addition to which, such component demonstrates the power to absorb a considerable quantity (e.g. 30%) of its weight of a liquid. While it is preferable that the wool fat, wool grease and/or derivatives thereof are anhydrous, the hydrous form of wool fat, lanolin, may also be used. Wool fact derivatives, e.g. wool alcohol and especially cetyl alcohol in an amount 0.1–5% w/v, are also suitable additions therefor. Commercial anhydrous wool grease is a particularly preferred component as it dries faster than pure wool fat and is less expensive.

The preparation according to the invention may contain the following ingredients in preferred concentrations.

Concentrated phosphoric acid (95%) 5% to 35% V/V (for example, 25%)

Wool fat or wool grease and/or derivatives thereof—25–35% W/V (for example 25%)

Kaolin—10–15% W/V (for example 10%)

Methylated or Industrial Spirits to 100% volume

The preparation may also contain concentrated detergent and water. In a preparation containing these optional additives, the amount of methylated spirits may be 50 to 70% V/V, with an effective amount of concentrated detergent (for example up to 1% V/V) and water to 100% volume. The addition of a detergent can further stabilize the emulsion and also enable the product to be more easily removed from the hands.

Once the preparation has dried, (for example, overnight) the wool fat, wool grease and/or derivatives thereof, contained therein, form a protective barrier against moisture penetration, thus minimizing further corrosion at the applied location. Additionally, the preparation allows the phosphoric acid to remain in close contact with the rust until all the reaction has ceased. The water repellant nature of the wool fat, wool grease and/or derivatives thereof also prevents the preparation being washed away, thus lengthening the time between applications.

One particularly preferred preparation is composed of the following components.

Concentrated phosphoric acid—33⅓V/V

Commercial Anhydrous wool grease—25% W/V

Light or colloidal kaolin—10% W/V

Methylated or industrial spirits—to 100% volume

The process for the production of the rust treatment preparation according to the invention may comprise the steps of adding concentrated phosphoric acid and methylated or industrial spirits to wool fat, wool grease and/or derivatives thereof, the resultant heat of reaction being sufficient to melt the wool fat, wool grease and/or derivatives thereof, adding kaolin with constant stirring to the reaction mixture. The mixture may be added to a homogeniser, preferably while it is still warm, so as to further stabilize the emulsion. Finally the mixture was allowed to cool.

To facilitate the melting of the wool fat, wool grease and/or derivatives thereof, heat may be applied (the heat from a hot water bath being quite adequate). However, as the addition of strong acid to methylated spirits creates enough heat to melt the wool fat, wool grease and/or derivatives thereof, this step is generally unnecessary.

Alternatively the wool fat (et al) is placed in a reaction vessel and softened to a paste-like consistency by applying heat (the heat obtained from a hot water bath is quite adequate). The concentrated phosphoric acid is added and stirred into the wool fat. Kaolin in the form of a suspension in the methylated or industrial spirits is added with constant stirring to the resultant mixture. The subsequent heat of reaction enables any hitherto undissolved wool fat to completely dissolve. Detergent diluted in a relatively small volume of hot water is added with continued stirring. The reaction mixture is diluted to volume with hot water and cooled.

The following example of preparation is given below to illustrate the invention but it is in no way limiting.

EXAMPLE

To produce one liter of the preparation, 250 grams of commercial anhydrous wool grease was placed in a container. A mixture of 330 mls of 95% concentrated phosphoric acid and 500 mls of methylated spirits was prepared and added to the wool grease. The heat of reaction of the acid and methylated spirits was sufficient to dissolve all the wool fat. Once the wool fat had dissolved, 100 gram of light or colloidal kaolin was added to the mixture. If necessary, methylated spirits may be added to the liter volume mark. The mixture was placed in a homogeniser so as to further stabilize the emulsion and finally allowed to cool.

Turning to the method et al aspects of the invention and illustrating such aspects with reference to the just-described preferred composition, the emulsion is suitable for application by the hand. This is a convenient technique in instances where rust is not visible but can be felt by the hand and hence the composition can be spread over the affected surface. There are numerous situations where application by the hand is more accurate than other techniques (e.g. spraying). Because of the acidic nature of the composition prolonged contact with the skin is not advocated but no adverse effects, e.g. burning of the skin, are encountered provided that this preparation is washed off the hand once application is completed.

In conclusion, it must be emphasized that the above description is, in general, an illustration of the invention. For instance, the method of application need not be by the hand but may be by conventional methods (e.g. spraying), the order of addition of the ingredients may be altered and the stated component percentages can be varied. It is therefore to be understood that changes may be made in the particular embodiments of the invention described, which are within the full intended scope of the invention.

The claims defining the invention are as follows:

I claim:

1. A rust treatment preparation comprising:

from about 5% to about 35% V/V of about 95% concentrated phosphoric acid, from about 25% to about 35% W/V of an emulsifier selected from the group consisting of anhydrous wool fat, anhydrous wool grease, hydrous wool fat, hydrous wool grease and derivatives thereof, from about 10% to about 15% W/V of a stabilizer-absorbing agent; and a solvent selected from the group consisting of methylated and industrial spirits.

2. A rust treatment preparation as described in claim 1 further comprising:

about 33⅓% V/V of said concentrated phosphoric acid, wherein said emulsifier comprises about 25% W/V commercial wool grease and said stabilizer-absorbing agent comprises about 10% W/V of kaolin.

3. A rust treatment preparation and described in claim 1 wherein said emulsifier includes from about 0.1% to about 5% W/V of cetyl alcohol.

* * * * *